US008117998B2

(12) United States Patent
Kim et al.

(10) Patent No.: US 8,117,998 B2
(45) Date of Patent: Feb. 21, 2012

(54) HOT WATER SUPPLYING SYSTEM

(75) Inventors: Ho Keun Kim, Seoul (KR); Yong Bum Kim, Inchon-si (KR)

(73) Assignee: Kyungdong Navien Co., Ltd. (KR)

( * ) Notice: Subject to any disclaimer, the term of this patent is extended or adjusted under 35 U.S.C. 154(b) by 0 days.

(21) Appl. No.: 12/097,844

(22) PCT Filed: Mar. 14, 2008

(86) PCT No.: PCT/KR2008/001432

§ 371 (c)(1),
(2), (4) Date: Jun. 17, 2008

(87) PCT Pub. No.: WO2008/140184

PCT Pub. Date: Nov. 20, 2008

(65) Prior Publication Data

US 2010/0212604 A1 Aug. 26, 2010

(30) Foreign Application Priority Data

May 10, 2007 (KR) ..... 10-2007-0045518

(51) Int. Cl.
*E03B 7/10* (2006.01)

(52) U.S. Cl. ..... 122/406.1; 237/19; 237/80

(58) Field of Classification Search ..... 122/15.1, 122/19.1, 406.1, 406.3; 237/19, 62, 80
See application file for complete search history.

(56) References Cited

U.S. PATENT DOCUMENTS 3,608,818 A * 9/1971 Von Fellenberg ..... 237/8 B
4,529,033 A 7/1985 Blum
4,623,093 A * 11/1986 Arndt ..... 237/19
5,988,118 A * 11/1999 Park ..... 122/406.1
(Continued)

FOREIGN PATENT DOCUMENTS

JP 2004-44992 2/2004

OTHER PUBLICATIONS

International Search Resort for Application No. PCT/KR2008/001432, dated Jun. 20, 2008.

*Primary Examiner* — Gregory A Wilson
(74) *Attorney, Agent, or Firm* — Nelson Mullins Riley & Scarborough LLP; Anthony A. Laurentano

(57) ABSTRACT

The present invention relates to a hot water supplying system that includes a preheating-circulating system, which heats water to maximally reduce the time to attain a temperature set by a user, and is designed to use a portion of preheating energy for heating, preventing pipelines from being frozen to burst in winter by preheating-circulating. In order to achieve the object, the invention provides a hot water supplying system that includes: a water tank for storing water flowing into an inlet; a heat exchanger for heating the water flowed therein; a controller that compares a temperature measured by a temperature sensor disposed at a predetermined position in a pipeline through which water flows, with a set preheating temperature, and controls the operation of the heat exchanger; and a pump that is disposed in a pipeline connecting a first node, which is disposed in a pipeline connecting the heat exchanger with an outlet, with a second node, which is disposed in a pipeline connecting the inlet with the water tank. According to a hot water supplying system of the invention, a water tank storing a predetermined amount of water is provided in the hot water supplying system, such that it is possible to supply hot water heated by a set temperature in the shortest time when a user wants to use the hot water, by preheating water stored in the water tank and remaining in the pipelines even when the hot water is not being used, and to prevent the pipelines from freezing and bursting during the winter.

4 Claims, 7 Drawing Sheets

U.S. PATENT DOCUMENTS

| | | | | |
|---|---|---|---|---|
| 6,370,896 | B1 * | 4/2002 | Sakakibara et al. | 62/201 |
| 6,494,051 | B2 * | 12/2002 | Sakakibara et al. | 62/225 |
| 6,622,930 | B2 * | 9/2003 | Laing et al. | 237/80 |
| 7,021,073 | B2 * | 4/2006 | Sakakibara | 62/238.7 |
| 7,322,532 | B2 * | 1/2008 | Takada et al. | 236/11 |
| 7,856,835 | B2 * | 12/2010 | Ida | 62/150 |
| 2002/0014085 | A1 * | 2/2002 | Sakakibara et al. | 62/201 |
| 2005/0072853 | A1 | 4/2005 | Roet et al. | |
| 2009/0113911 | A1 * | 5/2009 | Nakayama | 62/238.6 |
| 2009/0222111 | A1 * | 9/2009 | Matsuoka et al. | 700/78 |
| 2009/0250203 | A1 * | 10/2009 | Ida | 165/287 |
| 2010/0212604 | A1 * | 8/2010 | Kim et al. | 122/32 |

* cited by examiner

【Figure 1】
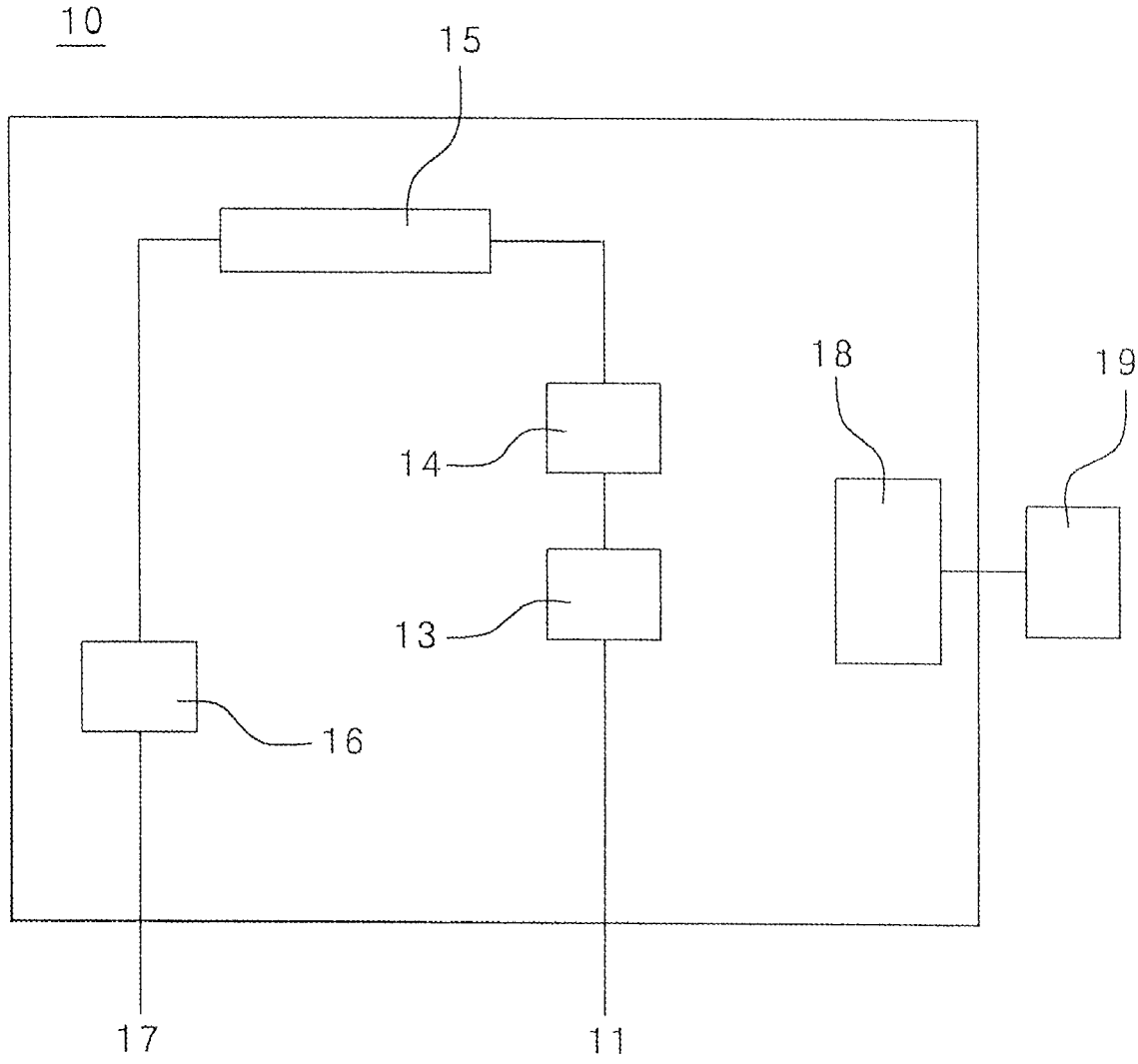

[Fig. 2]
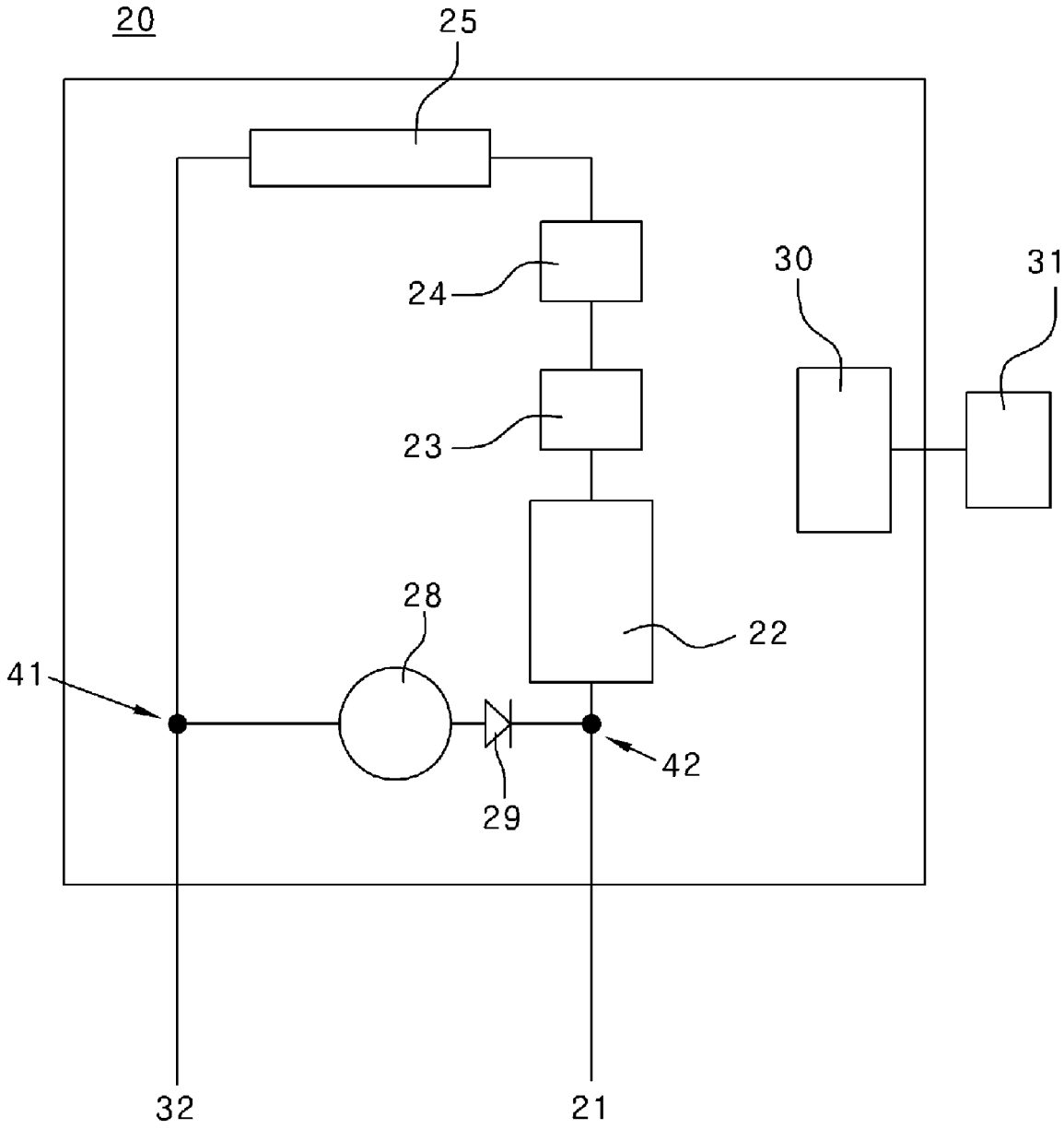

[Fig. 3]
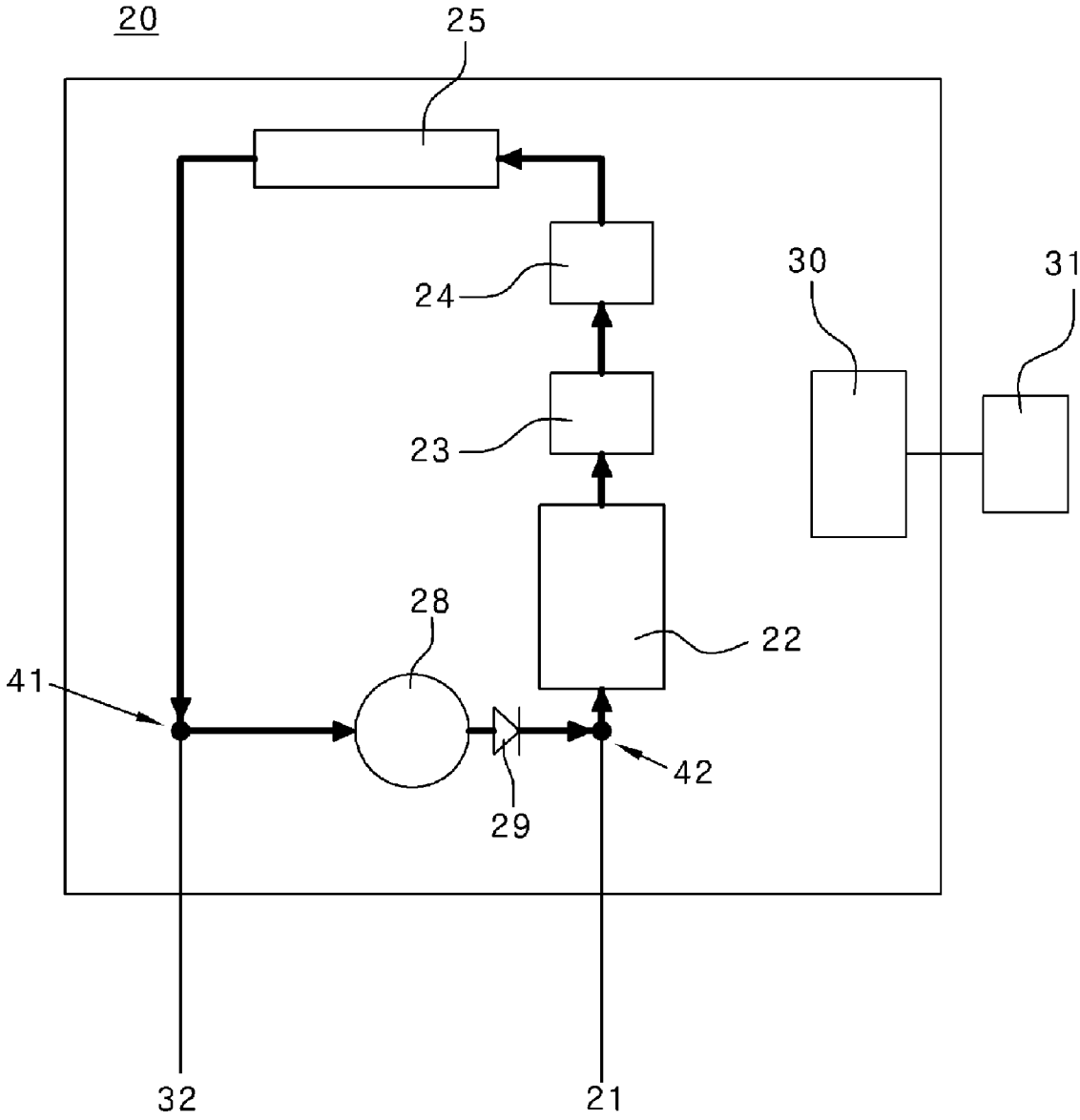

[Fig. 4]
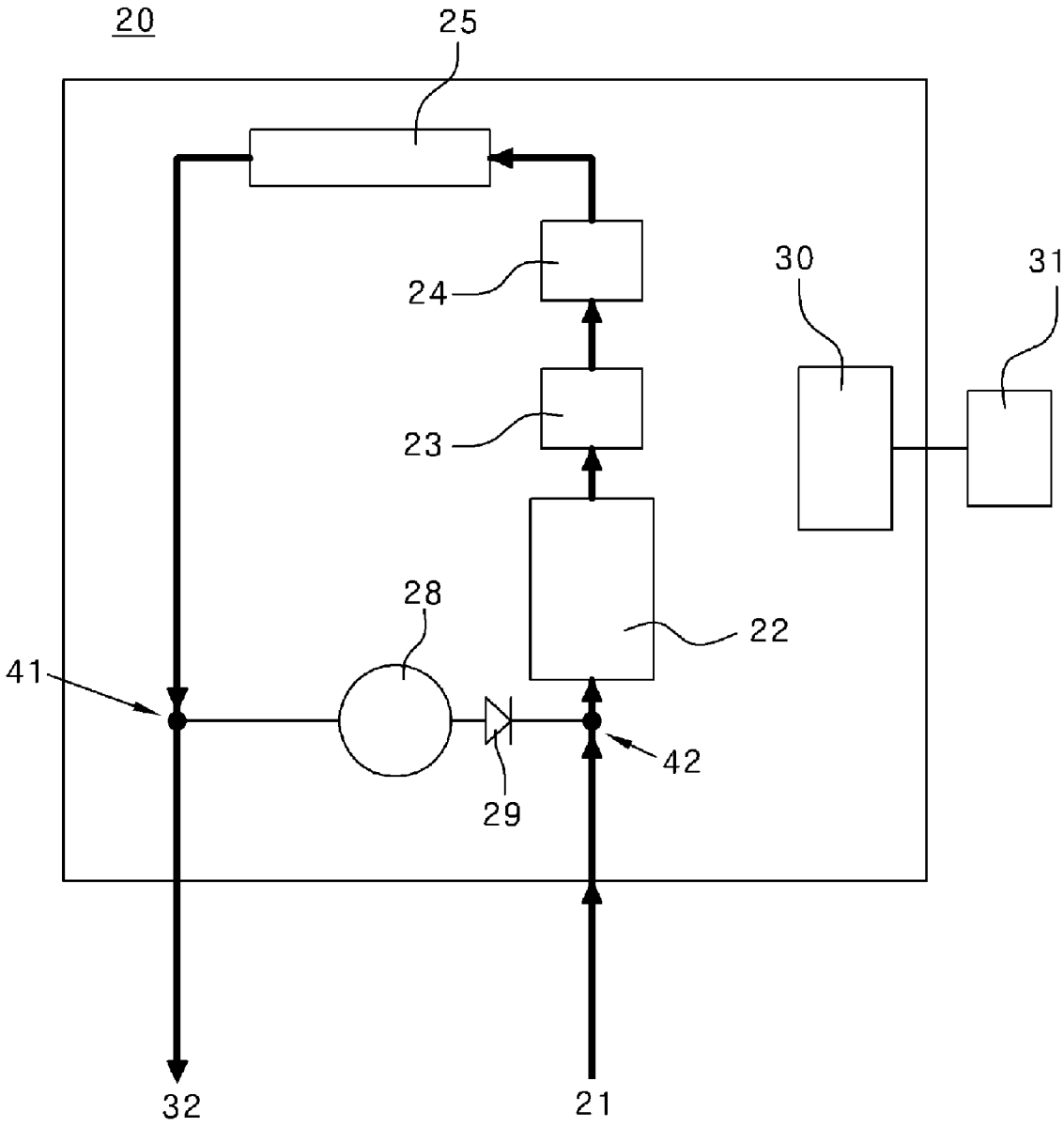

[Fig. 5]
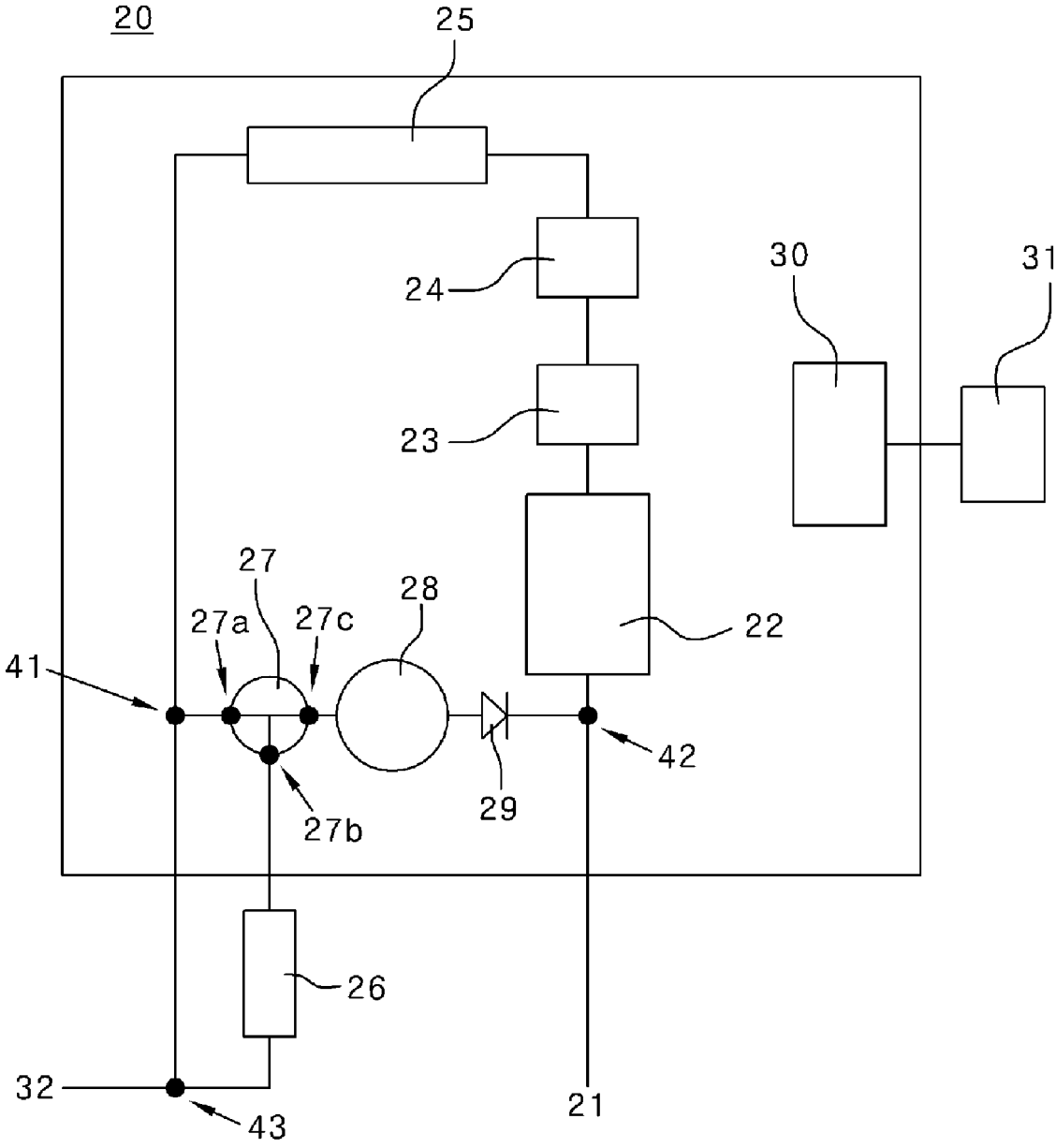

[Fig. 6]
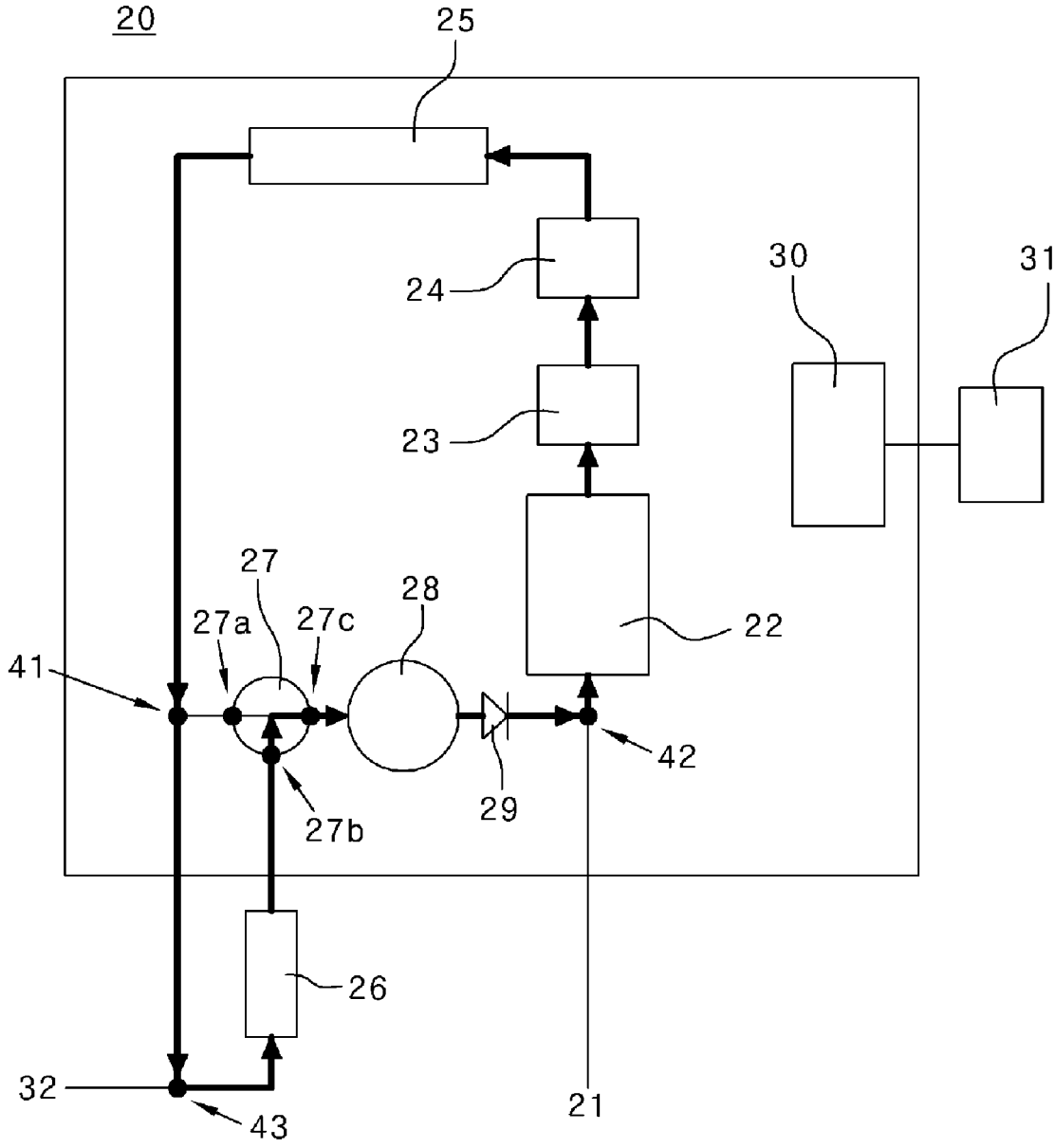

[Fig. 7]
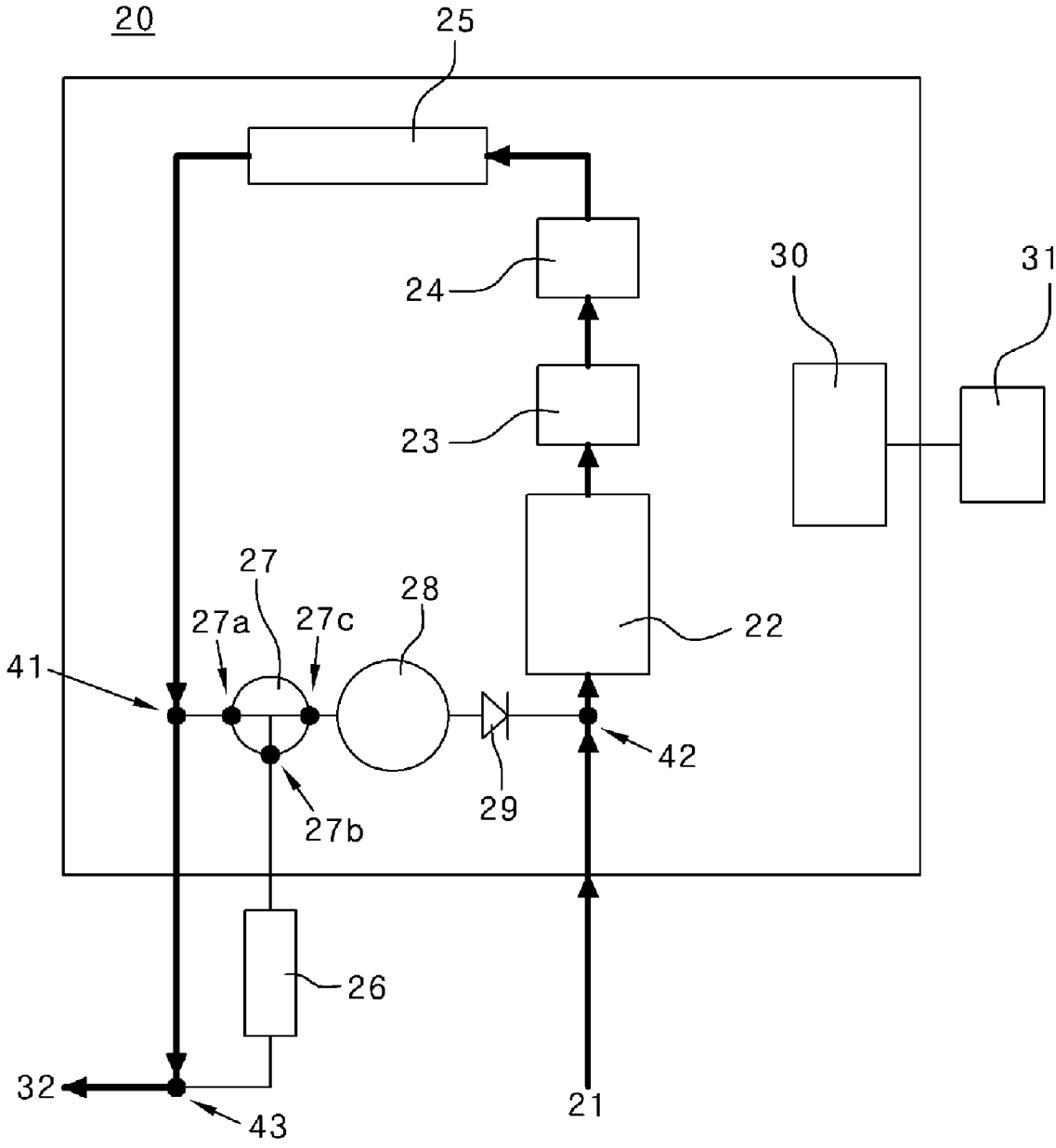

HOT WATER SUPPLYING SYSTEM

TECHNICAL FIELD

The present invention relates to a hot water supplying system, particularly a hot water supplying system for heating cold water flowing into an inlet to a temperature set by a user and then supplying the heated water through an outlet, which includes a preheating-circulating system that maximally reduces the time to attain the set temperature, and is designed to use a portion of preheating energy for heating and prevents pipelines from freezing and bursting during the winter by circulating the preheated water.

BACKGROUND ART

In general, a hot water supplying system is designed to heat water to a temperature set by a user in a short time and then supply the heated water, and in a hot water supplying system, important factors to determine the performance of the system are how long it takes to heat the water to the temperature set by the user and whether to be able to supply the water with the temperature maintained at the set level even if the amount of water that is used changes.

FIG. 1 is a view showing the configuration of a hot water supplying system in the prior art.

According to the configuration of a hot water supplying system 10 in the prior art, as water flowing into an inlet 11 passes through a heat exchanger 15, it is heated by a heating device (burner) provided in the heat exchanger 15, such that hot water is supplied through an outlet 17 to a user.

A flow sensor 14, an inflow temperature sensor 13, and an outflow temperature sensor 16 that detect the flow and temperature of water are disposed in the pipeline from the inlet 11 to the outlet 17.

A controller 18 compares a temperature detected by the sensors with a temperature set by a user using a temperature setting device 19 and maintains the water at the set temperature by determining the combustion intensity of the heating device in the heat exchanger 15, depending on the compared results.

DISCLOSURE

Technical Problem

Even though the hot water supplying system 10 in the prior art supplies hot water that is heated at a set temperature in a short time by instantaneously providing much heat energy through heating by the heat exchanger 15, water flowing into the inlet 11 is at a low temperature when the outdoor temperature is low such as during winter, and therefore there is a limit in reducing the time that is taken to supply high-temperature water by heating the low-temperature water in the heat exchanger 15.

Further, if the pause state of the hot water supplying system 10 is maintained for a long time in the winter, the pipelines may be frozen and burst. When a separate heating device is provided to prevent the pipelines from bursting, additional loss of energy is correspondingly generated.

Technical Solution

The present invention has been invented to overcome the above problems and it is an object of the invention to provide a hot water supplying system that has a preheating-circulating system for maximally reducing the time to attain a temperature set by a user and can use heat energy of flowing hot water for heating, by changing the path of water flowing in the preheating-circulating system on the basis of whether the hot water is used or not.

In order to achieve the objects, the present invention provides a hot water supplying system that heats low-temperature water flowing into an inlet to a high temperature and supplies hot water through an outlet, and the hot water supplying system comprises a water tank for storing water flowed into the inlet; a heat exchanger for heating the water flowed therein; a controller that compares a temperature measured by a temperature sensor with a predetermined preheating temperature and controls the operation of the heat exchanger, the temperature sensor being disposed at a predetermined position in a pipeline through which water flows; and a pump that is disposed on a pipeline connecting a first node with a second node, wherein the first node is disposed on a pipeline connecting the heat exchanger with the outlet, and the second node is disposed on a pipeline connecting the inlet with the water tank.

Further, a check valve is further provided on a pipeline connecting the pump with the second node.

Further, a third node is disposed on a pipeline connecting the first node with the outlet, and a three-way valve is provided between the first node with the pump such that the preheated water passes through a radiator disposed in a separate pipeline connecting the third node with the three-way valve.

Advantageous Effects

As described above, according to a hot water supplying system of the invention, since a water tank storing a predetermined amount of water is provided with the hot water supplying system, and water stored in the water tank and remaining in the pipelines is preheated even when the hot water is not used, it is possible to supply hot water heated to a set temperature in the shortest time whenever a user wants to use the hot water, and to prevent the pipelines from freezing and bursting in the winter.

Further, since the flow path of water in the preheating-circulating process is controlled such that the water passes through a radiator at the outside by manually operating a three-way valve, it is possible to use the hot water supplying system as a heating device, in addition to preheating the water remaining in the hot water supplying system, by using only one inner pump.

DESCRIPTION OF DRAWINGS

FIG. 1 is a view showing the configuration of a hot water supplying system in the prior art;

FIG. 2 is a view showing the configuration of a hot water supplying system according to a first embodiment of the invention;

FIG. 3 is a view showing a flow path of water while preheating according to a first embodiment of the invention;

FIG. 4 is a view showing a flow path of water while using hot water according to a first embodiment of the invention;

FIG. 5 is a view showing the configuration of a hot water supplying system according to a second embodiment of the invention;

FIG. 6 is a view showing a flow path of water while preheating according to a second embodiment of the invention; and FIG. 7 is a view showing a flow path of water while using hot water according to a second embodiment of the invention.

BEST MODE

Configurations and operations of preferred embodiments of the invention are described hereafter in detail with reference to the accompanying drawings.

FIG. 2 is a view showing the configuration of a hot water supplying system according to a first embodiment of the invention, FIG. 3 is a view showing a flow path of water while preheating, and FIG. 4 is a view showing a flow path of water while using hot water.

As shown in FIG. 2, a hot water supplying system 20 according to a first embodiment of the invention includes a water tank 22 for storing water flowing into an inlet 21, a heat exchanger 25 for heating the water, a temperature sensor 23 and a flow sensor 24 that are disposed on a pipeline connecting the water tank 22 with the heat exchanger 25, a pump 28 that is disposed on a pipeline connecting a first node 41, which is disposed on a pipeline connecting the heat exchanger 25 with an outlet 32, with a second node 42, which is disposed on a pipeline connecting the inlet 21 with the water tank 22, and a check valve 29 for preventing a backward flow.

The hot water supplying system 20 according to the first embodiment has a closed inner circular path of the pipeline connecting the inlet 21 with the outlet 32. Accordingly, since water remaining in the hot water supplying system 20 is preheated while a user does not use the hot water, the water can be heated at a temperature set by the user within a short time when the user starts to use hot water.

About 2 l of water is stored in the water tank 22, which flows into the inlet 21. The water stored in the water tank 22 and the water remaining in the inner pipeline of the hot water supplying system 20 are preheated while the user does not use hot water such that the preheated water can reach a desired high temperature within a short time at the time the user starts to use hot water.

FIG. 3 is a view showing a flow path of water in which water is being preheated while the user does not use the hot water. While the hot water is not being used, the outlet 32 is closed and water is preheated, flowing through the path indicated by a thick line by the pump 28.

The temperature sensor 23 is disposed in the pipeline connecting the water tank 22 with the heat exchanger 25, and during preheating, the controller 30 connected with the temperature sensor 23 compares a temperature measured by the temperature sensor 23 with a predetermined preheating temperature set by the user. For example, if the preheating temperature is set at 40° C. by the user, the controller 30 controls to stop heating in the heat exchanger 25 when the temperature measured by the temperature sensor 23 is +5° C. or more higher than the set preheating temperature, and controls to start heating in the heat exchanger 25 when the temperature measured by the temperature sensor 23 is −5° C. or more lower than the set preheating temperature. It is apparent to those skilled in the art that the above set temperature and the temperature range can be changed by the user.

Further, the temperature sensor 23 may be disposed anywhere in the pipeline through which the water flows, but it may be preferable to dispose the temperature sensor 23 at a position in the pipeline right after the water tank 22 having large heat capacity and set a temperature measured at the position as a reference temperature of the water.

FIG. 4 is a view showing a water flow path while using hot water, in which the water flowing into the inlet 21 passes through the water tank 22 and is heated by the heat exchanger 25. Then, the water is discharged through the outlet 32 and supplied to the user.

When the user opens a valve at the outlet 32 to use the hot water, all of the water which reaches the first node 41, is discharged through the outlet 32 by the pressure difference, and the inner circulation as shown in FIG. 3 is no longer made.

The flow sensor 24 is disposed in the pipeline connecting the water tank 22 with the heat exchanger 25, such that when water flow is detected, the flow sensor 24 sends a detection signal to the controller 30 and the controller 30 actuates the heat exchanger 25.

It is possible to obtain the functional effect of preventing the pipelines from freezing and bursting during the winter, by the preheating configuration according to the first embodiment.

FIG. 5 is a view showing the configuration of a hot water supplying system according to a second embodiment of the invention, FIG. 6 is a view showing a flow path of water while preheating, and FIG. 7 is a view showing a flow path of water while using hot water.

As show in FIG. 5, the configuration of the hot water supplying system 20 according to the second embodiment of the invention is additionally provided with a three-way valve 27 disposed on the pipeline connecting the first node 41 with the second node 42, including the configuration according to the first embodiment. Further, a third node 43 is disposed on a pipeline connecting the first node 41 with the outlet 32, and a radiator 26 is disposed on a separate pipeline connecting the third node 43 with the three-way valve 27. The three-way valve 27 has two inlets 27*a*, 27*b* and one outlet 27*c* and can change the flow path of water.

As shown in FIG. 6, in a preheating-circulating process according to the second embodiment, when a user does not use hot water, the first inlet 27*a* of the three-way valve 27 and the outlet 32 are closed, and the second inlet 27*b* and the outlet 27*c* of the three-way valve 27 are open, such that inner circulation of water is created by the path as shown in the figure.

It is possible to prevent pipelines from freezing and bursting at temperatures below zero during the winter, using the configuration of the hot water supplying system 20. Further, the hot water supplying system 20 can be used as a heating device by transferring heat of the hot water to the radiator 26.

The invention is also characterized in that it is possible to supply hot water and achieve outside-heating by circulating the water, using only one pump 28, as shown in FIG. 6. FIG. 7 is a view showing a flow path of water when a user uses hot water, which is the same as in the first embodiment shown in FIG. 4.

INDUSTRIAL APPLICABILITY

According to the present invention, it is provided a hot water supplying system that includes a preheating-circulating system which enables to maximally reduce the time to attain a temperature set by a user, and is designed to use a portion of preheating energy for heating, preventing pipelines from freezing and bursting in winter with preheating-circulating.

The invention claimed is:

1. A hot water supplying system that heats low-temperature water flowing into an inlet to a high temperature and supplies hot water through an outlet, the hot water supplying system comprising:

a water tank for storing water flowed into the inlet;

a heat exchanger for heating the water flowed therein;

a controller that compares a temperature measured by a temperature sensor with a set preheating temperature and controls the operation of the heat exchanger, the temperature sensor being disposed at a predetermined position in a pipeline through which water flows; and a pump that is disposed in a pipeline connecting a first node with a second node, the first node being disposed on a pipeline connecting the heat exchanger with the outlet, and the second node being disposed on a pipeline connecting the inlet with the water tank, wherein a closed path is formed connecting the first node, the water tank and the second node so as to preheat the water in the water tank and in the pipelines only when the hot water is not supplied through the outlet, and wherein the pump is controlled to generate a pressure to circulate the water along the closed path only when the hot water is not supplied through the outlet.

2. The hot water supplying system according to claim 1, further comprising: a check valve disposed on the pipeline connecting the pump with the second node.

3. The hot water supplying system according claim 2, wherein a third node is disposed on a pipeline connecting the first node with the outlet, and wherein a three-way valve is provided between the first node and the pump such that preheated water passes through a radiator which is disposed on a separate pipeline connecting the third node with the three-way valve.

4. The hot water supplying system according claim 1, wherein a third node is disposed on a pipeline connecting the first node with the outlet, and wherein a three-way valve is provided between the first node and the pump such that preheated water passes through a radiator which is disposed on a separate pipeline connecting the third node with the three-way valve.

* * * * *